United States Patent [19]

Nabulon

[11] Patent Number: 4,877,570

[45] Date of Patent: Oct. 31, 1989

[54] METHOD FOR CONTINUOUSLY CRIMPING THERMOPLASTIC FILAMENTS

[75] Inventor: Werner Nabulon, Rüdlinger, Switzerland

[73] Assignee: Rieter Machine Works Ltd., Winterthur, Switzerland

[21] Appl. No.: 251,817

[22] Filed: Oct. 3, 1988

[30] Foreign Application Priority Data

Oct. 5, 1987 [CH] Switzerland ..... 03874/87

[51] Int. Cl.[4] ..... D02G 1/00

[52] U.S. Cl. ..... 264/282; 28/257; 264/168

[58] Field of Search ..... 264/168, 285, 282; 28/247, 254, 257; 57/350, 351

[56] References Cited

U.S. PATENT DOCUMENTS 3,816,887 6/1974 Smith et al. .

FOREIGN PATENT DOCUMENTS 2110670 1/1972 Fed. Rep. of Germany .
2236024 2/1974 Fed. Rep. of Germany .
2264669 6/1974 Fed. Rep. of Germany .
2507752 8/1976 Fed. Rep. of Germany .
141761 5/1980 Fed. Rep. of Germany ..... 28/257
34806 8/1984 Japan ..... 29/257

*Primary Examiner*—James Lowe
*Attorney, Agent, or Firm*—Werner W. Kleeman

[57] ABSTRACT

For continuously crimping thermoplastic filaments, a filament bundle is blown by a jet nozzle into a stuffing chamber of a texturing wheel to produce a crimped filament bundle in the stuffing chamber. The stuffing chamber has a receiving zone, a treatment zone and a delivery zone. The filament bundle is subjected to a texturing or crimping treatment in the receiving zone and, depending upon the fiber material to pe processed, undergoes a heating or cooling treatment in the treatment zone. The heating or cooling treatment is accomplished by a blowing agent which blows a gaseous medium into the stuffing chamber. At the delivery zone, the crimped filament bundle is taken-off or lifted-out of the stuffing chamber by fiber bundle-lifting means and moved towards a suction drum receiving the filament bundle. The reception of the crimped fiber bundle at the suction drum is assisted by a suction passage in the suction drum which sucks air through a porous surface thereof so that the filament bundle remains adhering to such suction surface and is further cooled by the ambient air. The texturing wheel and the suction drum are rotatably and drivably mounted.

9 Claims, 9 Drawing Sheets

METHOD FOR CONTINUOUSLY CRIMPING THERMOPLASTIC FILAMENTS

BACKGROUND OF THE INVENTION

The present invention relates to a new and improved method of, and apparatus for, continuously texturing or crimping thermoplastic filaments.

In its more particular aspects, the texturing or texturizing method of the present invention is of the type wherein thermoplastic filaments are blown-in or introduced in the form of a filament bundle by means of a jet or stream of a heated medium with the aid of a jet nozzle into a stuffing chamber of elongate curvature or curved configuration substantially tangentially with respect to such elongate curvature of the stuffing chamber and at a forwarding speed which is greater than the circumferential velocity of the stuffing chamber.

As to the texturing or texturizing apparatus of the present development such is of the type which comprises a jet nozzle for introducing or blowing-in a filament bundle by means of a jet or stream of a medium, such as air, steam or mixtures thereof, into an annular or ring-shaped rotatable and drivable stuffing chamber. This stuffing chamber possesses an inlet or blow-in or receiving zone or region for receiving and crimping the filament bundle, a treatment or heat transfer zone or region for heating or cooling the received filaments of the filament bundle and a delivery zone or region for delivering or outfeeding the crimped filaments to a subsequent conveying element or fiber bundle-fitting or take-off element or means, for example, a cooling drum or drafting roller or conveying roller.

The main criteria as concerns crimping thermoplastic filaments, also sometimes referred to in the art as filament threads or yarns, are intense filament crimping in the crimping technique apparatus and durability of the filament crimping following the crimping operation. As to such type of filament crimping technique such constitutes a stuffing crimping operation wherein a filament bundle, which has been heated by a heated gaseous medium, is blown into a stuffing chamber where the stuffed filament bundle is brought into a crimped condition within the stuffing chamber because of the decelerated speed of conveyance of the filament bundle within the stuffing chamber. In this crimped condition the filament cools below the softening point so that when the crimped filament bundle is again withdrawn there remains a permanent crimp.

Such type of method is known, for example, from German Published Application No. 2,110,670, published Jan. 27, 1972. Here a jet nozzle blows-in or introduces the filament substantially tangentially into an elongate curved tunnel-like stuffing chamber. This stuffing chamber is provided in the circumferential or peripheral direction with a cooling drum which has a perforated surface. Cooling air is ejected through such perforated surface so that, as previously mentioned, the stuffed filament is cooled to produce thereat a permanent crimp.

This problem of fabricating a crimped filament is solved in a somewhat different manner in the apparatus which has been disclosed in German Published Patent Application No. 2,507,752, published Aug. 26, 1976. Here the filament thread which has been heated and pre-drafted by heated godets and after issuing from a jet nozzle is hurled against a screen wall in order to experience pre-crimping. The filament thread rebounding from the screen wall is then engaged by needles of a rotating belt so that the pre-crimped filament thread forms a plug between the needles. These needles then convey the plug into a heating channel or passage which narrows in order to compress the plug. Following the heating channel or passage the plug is then again released by means of a release device.

U.S. Pat. No. 3,816,887, granted June 18, 1974 discloses another construction of bulking or crimping apparatus wherein the filaments are blown-in or introduced in the form of a filament bundle or bunch by means of a stream of a heated medium and with the assistance of a jet nozzle into an elongate curved stuffing chamber substantially tangentially with respect to the curvature thereof and at a velocity greater than the circumferential velocity of the stuffing chamber. The injected filament bundle thus has imparted thereto a crimp which is subsequently cooled at the peripheral region of the stuffing chamber. The stuffing chamber comprises a groove formed in a cooling drum, and this groove is covered near to the site of blowing-in the filaments so that there is formed a closed chamber. Also, the base or floor of the groove is perforated so that external air can be sucked-in to cool the filaments. The crimped filaments are delivered at a predetermined location of the periphery of the groove to a subsequently arranged conveyor element.

One important aim or objective of a method or apparatus for continuously crimping thermoplastic yarns or threads is that the complete operation must not only give a result which is satisfactory from the technical point of view but it must also be very economical—i.e., operating conditions must be satisfactory and performance must be high. Operating conditions improve as less auxiliary agents, such as air, are required for cooling, or also improve in relation to the simplicity of construction of the crimping apparatus in order to achieve the same technological result with high efficiency, the term "technological result" denoting crimp density and durability or retentiveness of the crimp in the filament bundle during subsequent process steps.

A disadvantage of the heretofore discussed prior art is that most of the compounds or parts bounding the actual stuffing chamber are stationary and therefore very dependent on friction or frictional effects.

SUMMARY OF THE INVENTION

Therefore, with the foregoing in mind it is a primary object of the present invention to provide a new and improved method of, and apparatus for, texturing filament yarns or threads in a manner which is not associated with shortcomings or drawbacks existing in the prior art.

Another important object of the present invention is direct to the provision of a new and improved method of, and apparatus for, crimping filament yarns or threads in a very simple manner and using a few auxiliary means at a filament yarn or thread velocity of from at least 3,000 to 5,000 m/min.

Yet a further significant object of the present invention is directed to a new and improved method of, and apparatus for, texturizing filament yarns or threads with a jet nozzle and stuffing chamber coacting and structured such that the treatment medium necessary for texturing can issue at all sides from the filament bundle located in the stuffing chamber.

A further notable object of the present invention is directed to the provision of an improved method of, and apparatus for, texturing or crimping filament yarns or threads is a highly efficient and reliable fashion at relatively high throughput velocities and under favorable treatment conditions affording efficacious efflux of a treatment medium which has been brought into crimp-imparting relationship with the filament yarn or thread to be textured or crimped.

Now in order to implement these and still further objects of the present invention, which will become more readily apparent as the description proceeds, the texturing or crimping method of the present development, among other things, is manifested by the features that the stuffing chamber is constructed such that the medium required for the crimping of the filament bundle can escape or efflux at all sides from the filament bundle located in the stuffing chamber. In particular, the texturing or crimping method of the invention contemplates positively retaining or holding the infed filament bundle such that it is free at all sides for the essentially unimpeded outflow or efflux of the medium employed for the texturing or crimping of the filament bundle. Retention of the infed filament bundle is accomplished such that the filament bundle is positively held out of contact with the base or floor of the stuffing chamber and in a suspended state within the stuffing chamber. The infed filament bundle is preferably retained out of contact with the base of the stuffing chamber by holding such at the region of the upper half of the height of fluid or air pervious walls of the stuffing chamber.

As indicated heretofore the invention is not only concerned with the aforementioned method of texturing or crimping filament yarns or threads or filament bundles or the like, but also is concerned with apparatus constructions for the performance of the method aspects. The texturing or crimping apparatus of the present development, among other things, is manifested by the features that the stuffing chamber comprises two air-pervious annular or ring-shaped walls disposed in spaced-apart relationship with respect to one another on a texturing wheel. The jet nozzle substantially tangentially opens or enters between the mutually spaced walls with respect to the circumferential or peripheral surface of the texturing wheel and which forms the base or floor of the stuffing chamber and at a distance from such floor or base of the stuffing chamber such that the filament bundle is retained or held between these two mutually spaced walls in a manner that it neither lies or bears upon such base or floor nor at the outer edges or end regions of the walls.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
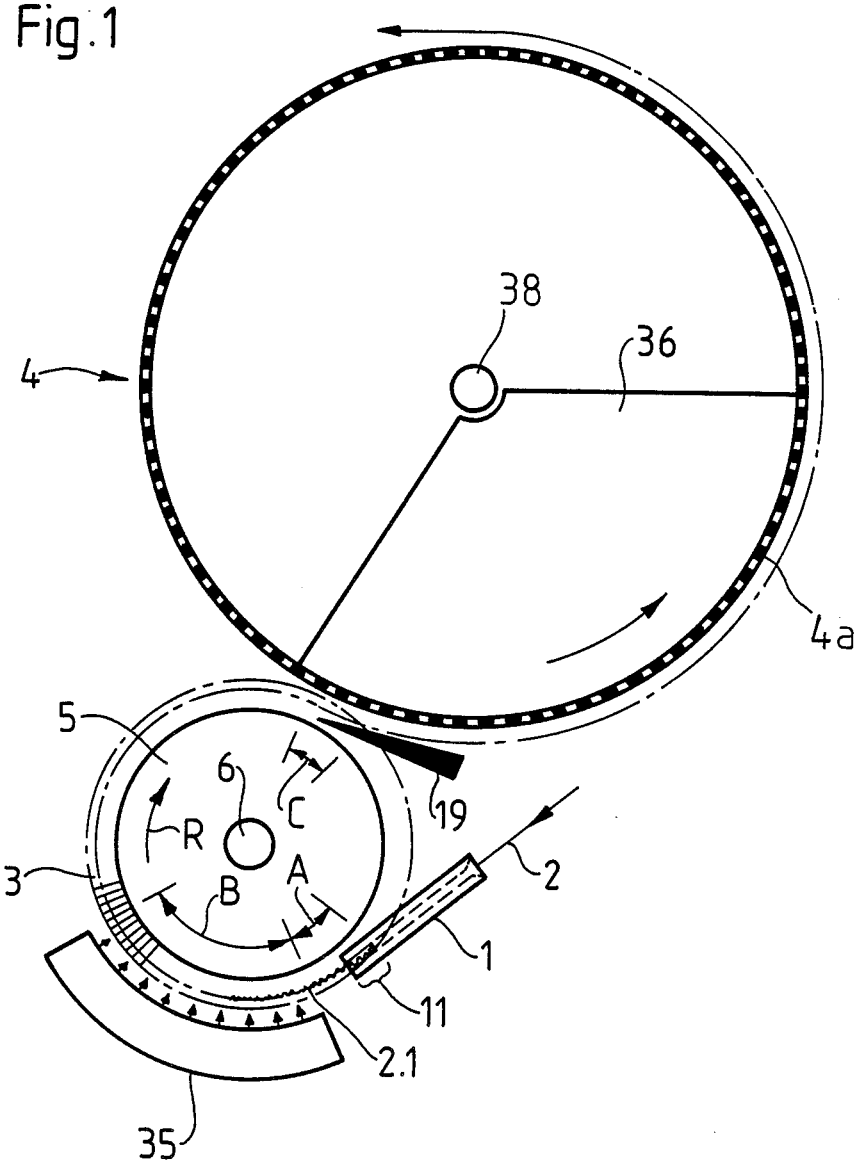
FIG. 1 schematically illustrates in front view an exemplary embodiment of texturing or crimping apparatus constructed according to the invention.

Describing now the drawings, it is to be understood that to simplify the showing thereof, only enough of the structure of the texturing or crimping apparatus for continuously texturing or crimping thermoplastic filaments or filament yarns or threads has been illustrated therein as is needed to enable one skilled in the art to readily understand the underlying principles and concepts of the present invention. Turning now specifically to FIG. 1 of the drawings, the texturing or crimping apparatus illustrated therein by way of example and not limitation will be seen to comprise a jet nozzle means 1 for injecting or introducing a filament bundle 2 together with a heated medium, such as preferably air, but also possibly steam or mixtures thereof, into an annual or ring-shaped stuffing chamber or compartment 3 which can be appropriately rotated and driven. The stuffing chamber 3 has an inlet or injection or receiving zone A for receiving and crimping the filament bundle 2, a treatment or heat transfer zone B for heating or cooling the crimped filament bundle 2.1 and a delivery or outlet zone C for delivering the crimped filament bundle 2.1 to a conveying element which in the case, for instance, is a suction drum or drum member 4 rotatable and drivable by means of a driven shaft 38. In order to transfer the crimped filament bundle 2.1 to the suction drum 4, there is shown a filament bundle-lifting or taking-off means 19 which will be considered in greater detail hereinafter.

The stuffing chamber 3 is disposed on the periphery or circumference of a texturing wheel or roller 5 mounted by means of a driven shaft 6 so as to be rotatable and drivable. The drive is not part of the invention and thus need not be here considered, particularly since a conventional drive can be used.

Figure 2:
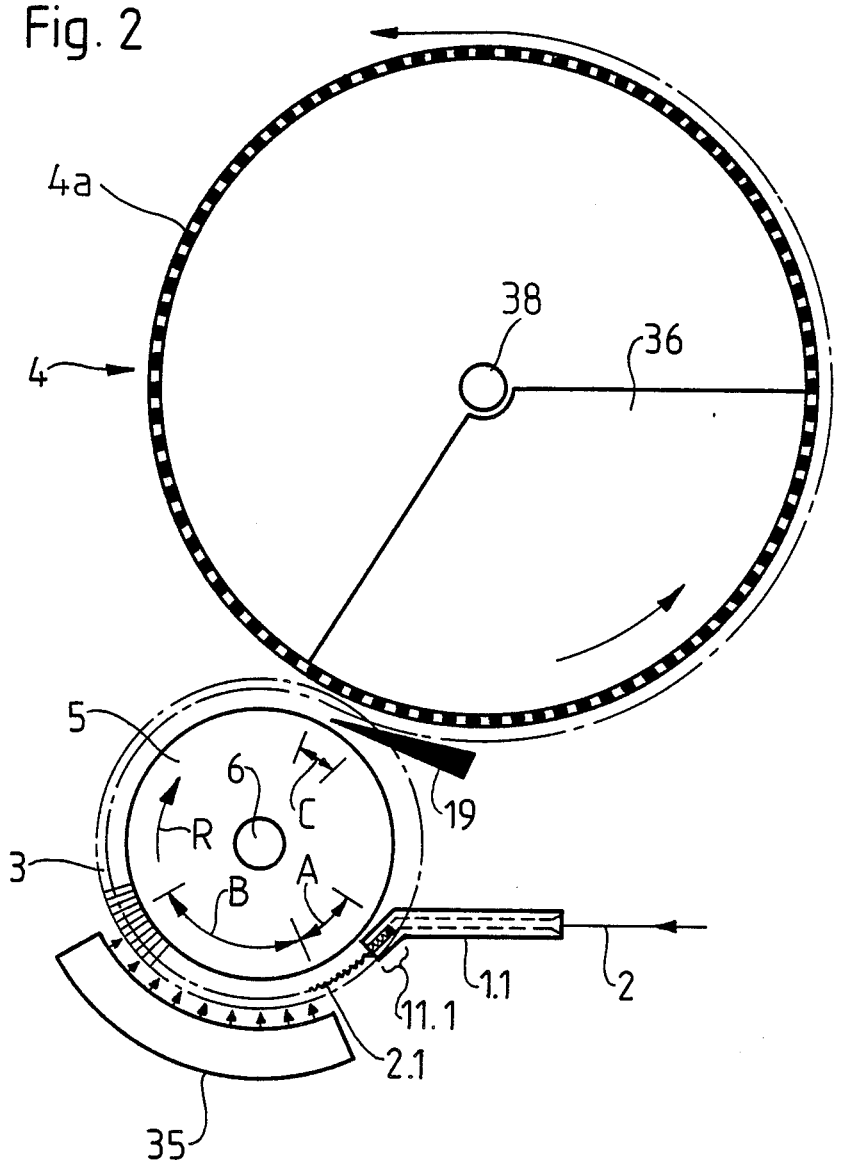
FIG. 2 schematically illustrates in front view a modified exemplary embodiment of texturing or crimping apparatus constructed according to the present invention.

FIG. 2 depicts a modified construction of the texturing or crimping apparatus and shows the same elements as FIG. 1 except for the jet nozzle which is here somewhat different in design. This jet nozzle 1.1 of the embodiment of FIG. 2 has, as compared with the generally linearly extending jet nozzle 1 of the embodiment of FIG. 1, a bent or flexed outlet part or portion 11.1 as is shown in an enlarged scale in FIGS. 21 through 25. The advantage of the bent outlet part 11.1 is that the jet nozzle 1.1 can extend substantially radially towards the stuffing chamber 3 but nonetheless, the outlet part 11.1 can be arranged tangentially thereto, something which has advantages in terms of the arrangement or spatial layout.

Figure 21:
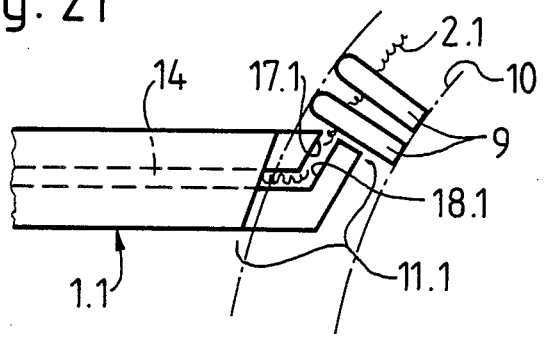
FIG. 21 again illustrates on an enlarged scale, part of the texturing or crimping apparatus, particularly a modified construction of a jet nozzle and its coaction with the texturing wheel.

Another advantage is that because of the bent walls 17.1 and 18.1 as shown, for instance, in FIG. 21, the filament bundle 2.1 which is guided and conveyed in the fiber or filament-guiding passage or duct 14 bounces or deflects at the bent wall 18.1, defining a deflecting plate or deflector, and is thus subjected to pre-crimping in addition to the pre-crimping produced by the escape of the fluid or gaseous medium, here typically air from the fiber or filament-guiding passage or duct 14 near the outlet part 11 and because of the friction prevailing between the filament bundle 2.1 and the bent walls 17.1 and 18.1.

In the embodiments herein disclosed where the jet nozzle has a bent outlet part, this bent outlet part, such as the bent outlet part 11.1 shown in FIG. 21, can enclose an angle of, for instance, about 90° to 170° with respect to the lengthwise axis of the substantially linear extending fiber or filament-guiding passage, such as the fiber or filament-guiding passage or duct 14 shown in FIG. 21.

Figure 3:
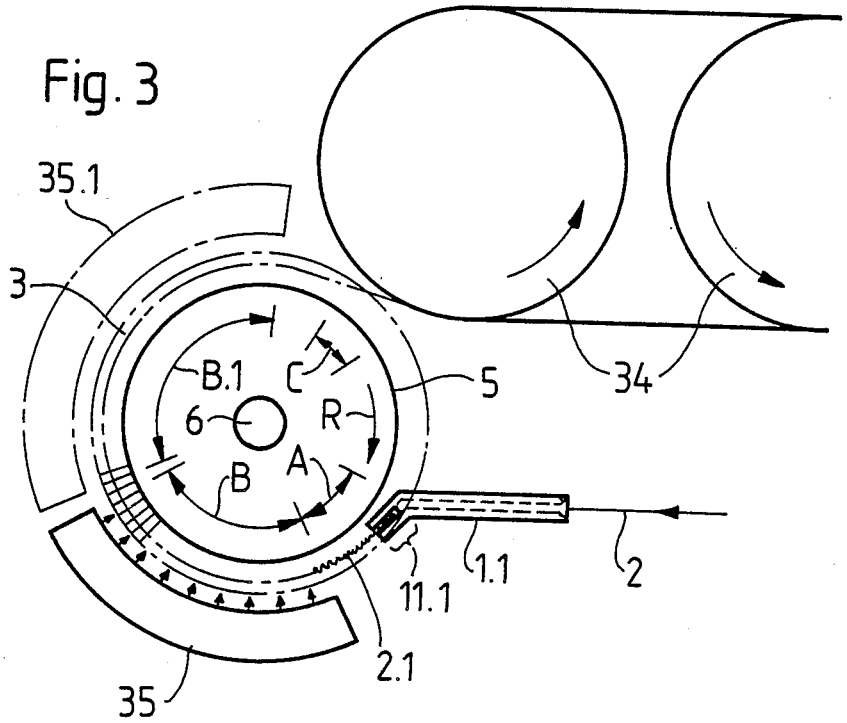
FIG. 3 schematically illustrates in front view a further modified exemplary embodiment of texturing or crimping apparatus constructed according to the present invention.

Also, FIG. 3 shows a variant of the arrangement of FIG. 2, wherein here there is provided a roll pair 34 for taking over the textured or crimped filament bundle 2.1 instead of there being used the suction drum 4. Basically, just a single conveying roll could be provided instead of the roll pair 34.

FIG. 3 also differs from the embodiment of FIGS. 1 and 2 in that in FIG. 3, the filament bundle-lifting or take-off means 19 are not used; instead, the roll pair 34 removes the filament bundle 2.1 from the stuffing chamber 3.

The arrangements of FIGS. 1, 2 and 3 show near the treatment or heat transfer zone B, a blow-in device or means 35 for blowing a gaseous treatment medium into the stuffing chamber 3 for treating the crimped filament bundle 2.1 therein with heat and/or cold. In addition to the means 35, additional or second means 35.1, shown in FIG. 3, having the same function can be provided. In this event, the first means 35 are used to heat the crimped filament bundle 2.1 in the stuffing chamber 3 and the additional or second means 35.1 are used to cold treat such filament bundle 2.1.

The additional or second means 36 are mainly used when, as shown in FIG. 3, there is not provided any suction drum 4 on which the textured or crimped filament bundle 2.1 can be further cooled and which is located downstream of the texturing wheel or roller 5 as has been shown for the embodiments of FIGS. 1 and 2.

The suction drum 4 depicted in FIGS. 1 and 2 has, for example, on its periphery or circumference, a screen surface or sieve **4*a* through which air can be sucked near the suction passage 36**.

The filament bundle-lifting or taking-off means 19 also can, of course, be used with the variant embodiment shown in FIG. 3. The difference between the use of the suction drum 4 as in the arrangements of FIGS. 1 and 2 and the use of a roll pair 34 as in the arrangement of FIG. 3, is that the crimped filament bundle 2.1 can be transferred automatically to the suction drum 4 by means of the filament bundle-lifting or taking-off means 19, whereas the crimped filament bundle 2.1 in the arrangement of FIG. 3 must be transferred by means of a suction nozzle or equivalent structure in order to be able to deposit the crimped filament bundle 2.1 on the roll pair 34. The filament bundle-lifting means 19 are therefore usually unnecessary with such arrangement.

Figure 5:
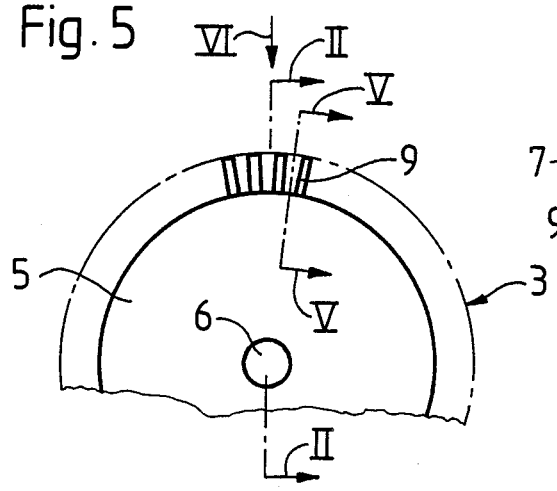
FIG. 5 is a fragmentary view of a modification of the arrangement of FIG. 4.
Figure 5A:
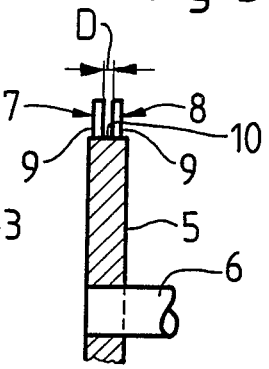
FIG. 5*a* is a cross-sectional view of the arrangement of FIG. 5, taken substantially along the line II—II thereof.

As illustrated in FIGS. 5 and 5*a*, the stuffing chamber 3 comprises two fluid or air-pervious annular or ring-shaped walls or wall means 7 and 8 disposed on the texturing wheel or roller 5 and spaced at a distance D from one another. In this example, the walls 7 and 8 are constituted by two respective needle or pin rows embodied by adjacent individual needles or pins 9 or equivalent structure inserted or embedded into the periphery or circumference of the texturing wheel or roller 5. That part or portion of the periphery or circumference of the texturing wheel 5 which is disposed between the needle rows of the walls 7 and 8, forms the base or floor 10 of the stuffing chamber 3.

Figure 19:
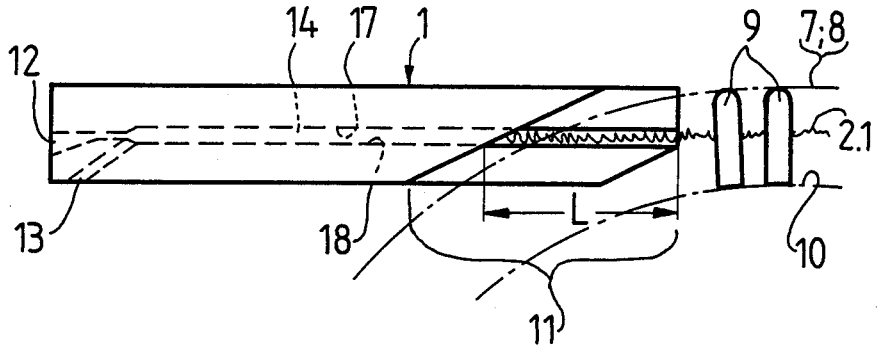
FIG. 19 illustrates on an enlarged scale part of the texturing or crimping apparatus, particularly the construction of the jet nozzle and its coaction with the texturing wheel.
Figure 20:
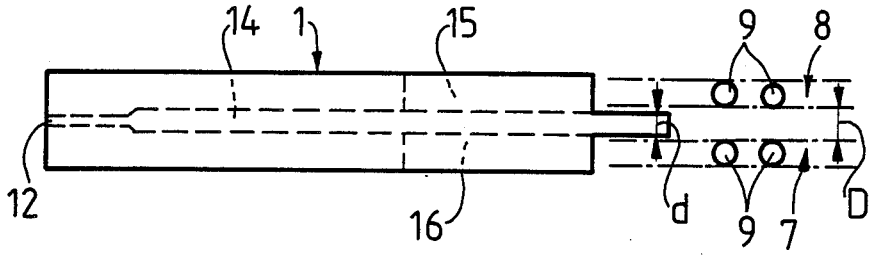
FIG. 20 is a top plan view of the arrangement of FIG. 19.

At this point, it is remarked that in FIGS. 19 and 20 there have been shown on an enlarged scale, the stuffing chamber or compartment 3 with the rows of needles 9 forming the walls 7 and 8 and the jet nozzle 1 whose outlet part or mouth portion 11 extends between the walls 7 and 8.

As will be seen from an inspection of FIGS. 19 and 20, the jet nozzle 1 comprises a filament entry or infeed orifice or port 12 through which the filament bundle 2 enters the jet nozzle 1 and with a fluid medium, such as an air infeed opening or aperture 13 through which a suitable pressurized fluid or gaseous medium, such as air, for instance, enters the fiber or filament-guiding passage or duct 14 through which the filament bundle 2 is guided and conveyed and which has entered through the filament infeed orifice 12.

The jet nozzle 1 is formed in its outlet part or mouth portion 11 with two recesses or openings or cutouts 15 and 16 which impart to such outlet part or portion 11 a width d corresponding at the maximum to the width D of the stuffing chamber 3 as has been illustrated in FIG. 20. These two recesses or openings 15 and 16 expose or free the fiber or filament-guiding passage or duct 14 in the outlet part or portion 11 over a length L visible in FIG. 19 such that the gaseous or fluid medium introduced into the fiber or filament-guiding passage or duct 14 can escape at least to some extent to atmosphere near such outlet part or portion 11. Because of such escape or efflux of the gaseous medium along the passage length L, the filament bundle 2 guided therein, starts to rub against the two other oppositely situated walls 17 and 18 because of the loss of at least some of the conveying medium, so that the speed of conveyance of the filament bundle 2 is reduced or retarded leading to stuffing of such filament bundle and, therefore, to precrimping in this part of the passage or channel.

Figure 4:
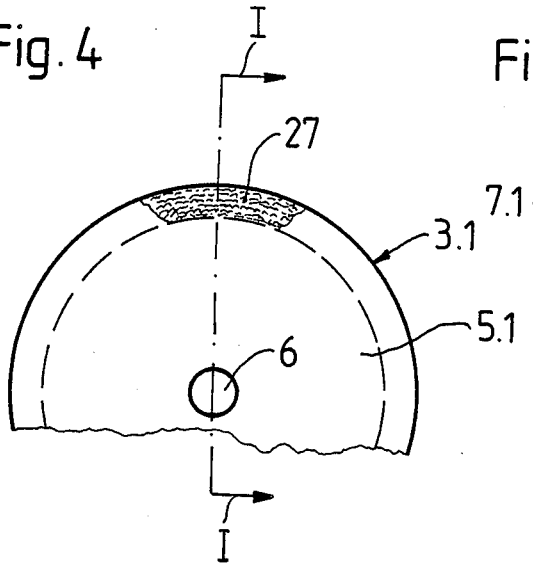
FIG. 4 is a fragmentary partial sectional view depicting details of the texturing or crimping apparatus of the arrangement of FIGS. 1 to 3.
Figures 4A, 4B:
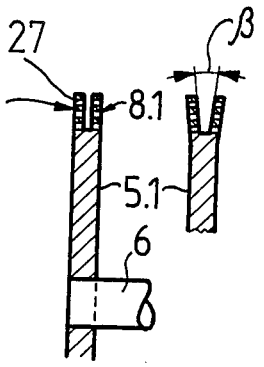
FIG. 4*a* is a fragmentary cross-sectional view of the arrangement of FIG. 4, taken substantially along the section line I—I thereof.
FIG. 4*b* is a sectional view, like the showing of FIG. 4*a*, depicting a modification of the arrangement of FIG. 4.

FIGS. 4, 4*a*, 6 and 7 each show a variant of the texturing wheel or roller 5 of FIG. 5. The texturing wheel 5.1 and the stuffing chamber 3.1 of FIG. 4 have, instead of the needle row walls 7 and 8, perforated walls 7.1 and 8.1 formed with continuous or open-ended bores 27 and defining discoid rings. Some of these continuous bores 27 are shown in FIGS. 4 and 4*a* and serve the same purpose as the spaces or gaps between the needles 9 which allow for the escape of the air or fluid medium.

To facilitate removal of the crimped filament bundle 2.1 in the delivery zone or region C between the perforated walls 7.1 and 8.1, the same can, as shown in FIG. 4*b*, having an opening angle or aperture angle $\beta$.

Figure 6:
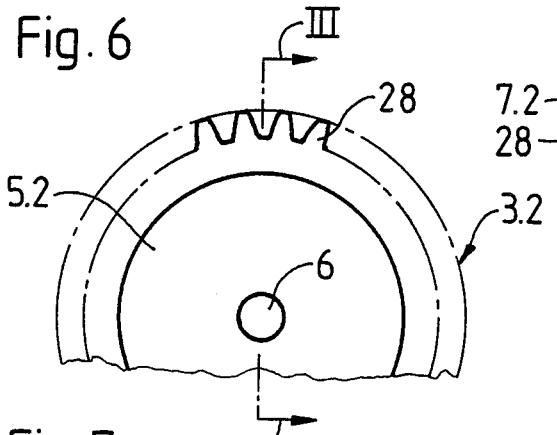
FIG. 6 is a fragmentary view of a further modification of the arrangement of FIG. 4.

FIG. 6 shows as a variant construction, instead of the needles 9, radial teeth 28 which form the walls 7.2 and 8.2 and the stuffing chamber 3.2.

Figure 6A:
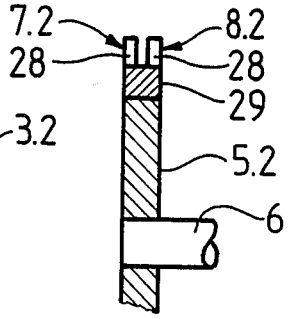
FIG. 6*a* is a cross-sectional view of the arrangement of FIG. 6, taken substantially along the line III—III thereof.

The radial teeth 28 are part of a tooth ring 29 drawn on to the texturing wheel 5.2 so as to be slip-free for operation. In the embodiment of FIGS. 6 and 6*a*, the teeth 28 are shown to constituted radial teeth.

Figure 7:
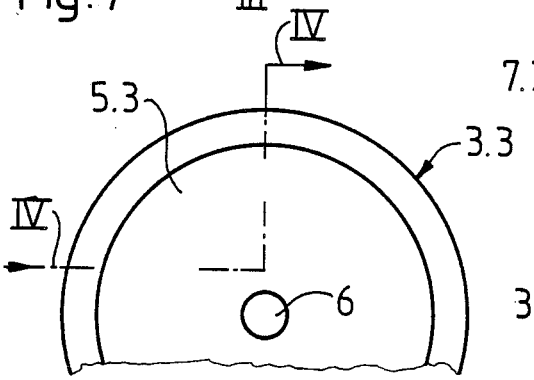
FIG. 7 is a fragmentary view of a still further modification of the arrangement of FIG. 4.
Figure 7A:
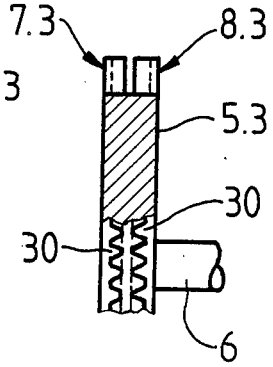
FIG. 7*a* is a cross-sectional view of the arrangement of FIG. 7, taken substantially along the line IV—IV thereof.

FIGS. 7 and 7*a* also show two tooth rows 7.3 and 8.3 which form the stuffing chamber 3.3. In this case, however, the teeth 30 extend axially with respect to the driven shaft 6 as can best be gathered from FIG. 7*a*.

Figure 8:
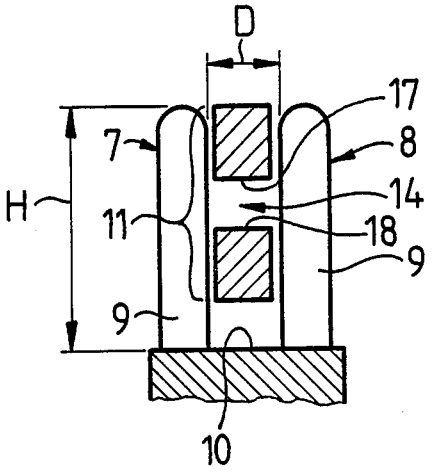
FIG. 8 is a fragmentary view, partially in section of a detail of the arrangement of FIG. 5, taken substantially along the line V—V thereof.

FIG. 8 illustrates an enlarged partial view along the section lines V—V of FIG. 5 and shows the walls 7 and 8 which are formed by the needles 9 and between which extends the outlet part or mouth portion 11.

As can be seen from FIG. 8, that part of the fiber or filament-guiding or conveying passage or duct 14 which belongs to the outlet part or portion 11 extends between the bounding walls 7 and 8 such that, as generally indicated in FIG. 1, the filament bundle 2 is introduced into the stuffing chamber 3 approximately halfway up the radial wall height H (FIG. 8) which laterally bounds the stuffing chamber 3.

The crimped filament bundle 2.1 adhering or clinging to the needles 9 of the walls 7 and 8 remains at this intermediate level and is positively guided in this position through the treatment zone or region B and also into the delivery zone or region C.

In the delivery zone C, the fiber bundle-lifting or taking-off means 19 extend between the walls 7 and 8 and desirably below the crimped fiber filament bundle 2.1 retained thereby.

Figure 9:
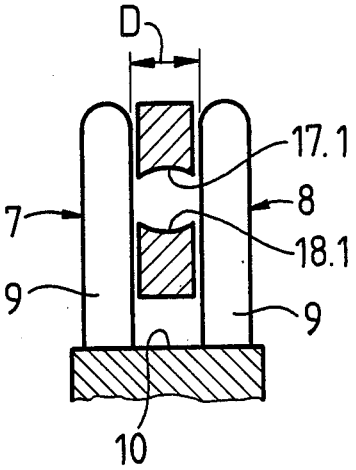
FIG. 9 is a fragmentary view, partially in section of a further modified detail of the arrangement of FIG. 5, taken substantially along the line V—V thereof.

At this point attention is directed to FIG. 9 in which a variant of the walls 17 and 18 of FIG. 8 is shown. In such FIG. 9, the oppositely situated walls 17.1 and 18.1 each have a concavity or concave configuration affording improved guidance of the crimped filament bundle 2.1 in the outlet part or portion 11.

Figure 10:
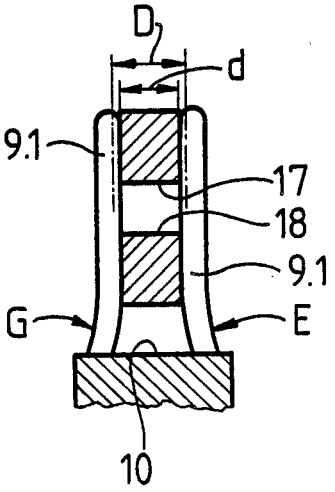
FIG. 10 is a fragmentary view, partially in section of a still further modified detail of the arrangement of FIG. 5, taken substantially along the line V—V thereof.

FIG. 10 shows a variant of the needles 9 and of the use of the outlet part or portion 11 according to FIG. 8. Here the needles 9.1 shown in FIG. 10 are resilient and biased into engagement with the outlet part or portion 11. Such engagement is represented diagrammatically in FIG. 10 by the curved parts E and G. The braking effect provided by this friction between the needles 9.1 and the outlet part or portion 11 can be reduced at least to some extent by the finish which is present on the filament bundle 2 and which is transferred to some extent to the outlet part or portion 11. In this way, there can be reduced abrasion between the needles 9.1 and the outlet part or portion 11.

Figure 11:
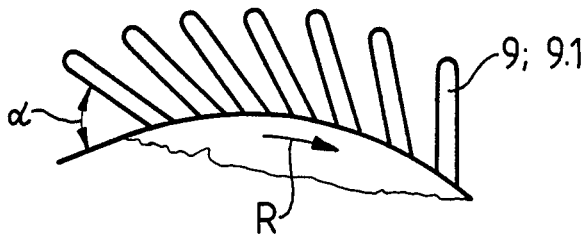
FIG. 11 illustrates in fragmentary view a variant construction of the arrangement of FIG. 5 and depicted on a somewhat enlarged scale.

Also, FIG. 11 shows a variant of the arrangement of the needles or pins 9 and 9.1, respectively, as compared with that of FIG. 5. Here the needles 9 or 9.1 are inclined to the rear as considered with respect to a predetermined direction of rotation R of the texturing wheel or roller 5. This needle inclination is represented by the angle $\alpha$ and must be determined in dependence upon needle length, texturing wheel diameter and the arrangement of the fiber bundle-lifting or taking-off means 19. The needle inclination should be such as to facilitate the lifting-out of the crimped filament bundle 2.1.

Figure 12:
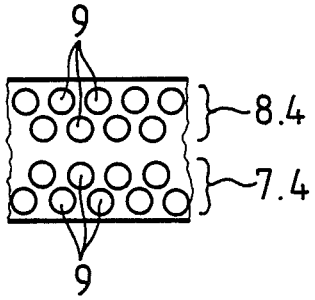
FIG. 12 illustrates a variant construction of the detail of FIG. 5 in fragmentary view and somewhat on an enlarged scale, as seen when looking in the direction of the arrow VI of FIG. 5.

In FIG. 12 and as compared with the previous illustrated constructions in which two rows of spaced needles are used to form the spaced-apart walls 7 and 8, here a double row of needles 9 is used for each wall 7.4 and 8.4. As such FIG. 12 shows, the two adjacent rows of needles 9 forming any one wall 7 and 8 are staggered relative to one another.

Figure 13:
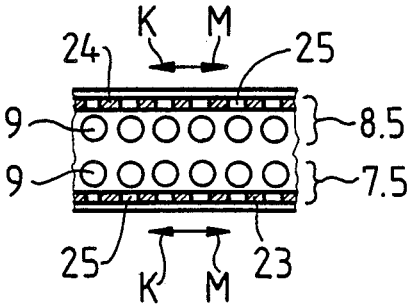
FIG. 13 illustrates a further variant construction of the detail of FIG. 5 in fragmentary view and somewhat on an enlarged scale, again as seen when looking in the direction of the arrow VI of FIG. 5.

FIG. 13 shows another variant construction wherein the walls 7.5 and 8.5 are each constituted by one row of needles 9 and a respective perforated annular or ring-shaped disc 23 and 24 which provides an at least partial closure or enclosure of the stuffing chamber 3 towards the outside, i.e., radially of the texturing wheel or roller 5. The partial closure arises because the two perforated annular or ring-shaped discs 23 and 24 can be selectively moved in the peripheral direction as indicated by the double-headed arrows K and M, respectively, so that the continuous apertures or bores 25 in the perforated annular or ring-shaped discs 23 and 24 are to some extent in alignment with the needles 9 and thus restrict the passage of air between the needles 9 to a given extent. The possibility that the perforated annual discs 23 and 24 can be rotated in the peripheral directions K and M, respectively, provides at least partial control of venting of the crimped filament bundle 2.1 disposed between the needle rows.

Figure 14:
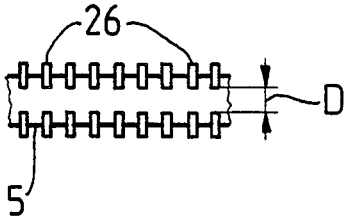
FIG. 14 illustrates a still further variant construction of the detail of FIG. 5 in fragmentary view and somewhat on an enlarged scale, likewise as seen when looking in the direction of the arrow VI of FIG. 5.

FIG. 14 shows a variant of the needle rows from the arrangement of FIGS. 5 and 5*a* and FIGS. 8 through 10, respectively, with lamellae or narrow plates 26 or equivalent structure being used instead of the heretofore described needles. The advantage of using lamellae 26 is that from the production standpoint, it is simpler to form slots in the texturing wheel or roller 5 instead of the fine bores necessary for receiving the needles 9. Also, the lamellae 26 or the like can be resilient so that, in response to the lifting of the crimped filament bundle 2.1 in the lifting or take-off region or zone, they experience, in a manner similar to that shown in FIG. 11, by virtue of the lifting of the crimped filament bundle 2.1, a bending action or flexing facilitating the lifting-out or take-off of the crimped filament bundle 2.1.

Figure 15:
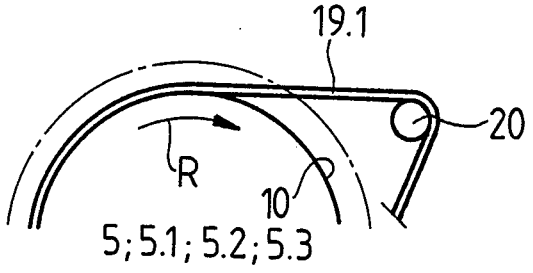
FIG. 15 illustrates in fragmentary view a modification of the texturing or crimping apparatus of the present development, particularly as concerns the taking-off or lifting means for the removal of the treated filament bundle from the texturing wheel.

Details of various possible constructions of the fiber or filament bundle-lifing or taking-off means 19 are shown in FIGS. 15 through 18. The filament bundle-lifting means 19 shown in FIG. 15 are in the form of an endless belt 19.1 which runs on the stuffing chamber base or floor 10 and is deflected around a deflecting roll or roller 20. The endless belt 19.1 lies flush on the base or floor 10 and is therefore moved by the texturing wheel or roller 5 without slip. This endless belt 19.1 departs from between the two mutually spaced air pervious walls of the associated stuffing chamber 5, 5.1, 5.2 or 5.3.

Figure 16:
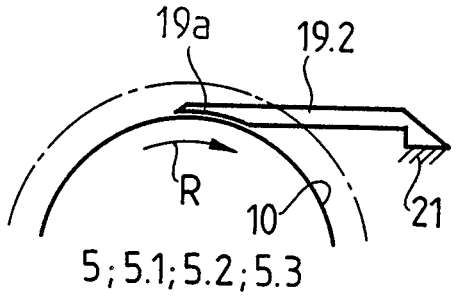
FIG. 16 illustrates in fragmentary view a further modification of the texturing or crimping apparatus of the present development, particularly as again concerns the taking-off or lifting means for the removal of the treated filament bundle from the texturing wheel.

FIG. 16 shows a stationary lifting wedge or wedge means 19.2 which terminates substantially tangentially with respect to the stuffing chamber base or floor 10 and which is rigidly connected to a fixed part or portion 21 of the machine frame. This stationary lifting wedge 19.2 has a substantially planar fiber-guiding surface 19*a*.

Figure 17:
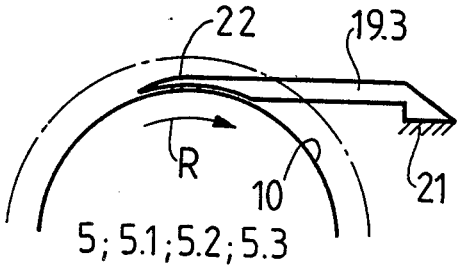
FIG. 17 likewise illustrates in fragmentary view yet a further modification of the texturing or crimping apparatus of the present development, particularly as again concerns the taking-off or lifting means for the removal of the treated filament bundle from the texturing wheel.

FIG. 17 also shows a stationary lifting wedge or wedge means 19.3 which is secured to the machine part 21 and has a convexity or concave portion 22 at the end near the texturing wheel or roller 5 to thus define a curved fiber-guiding surface.

Figure 18:
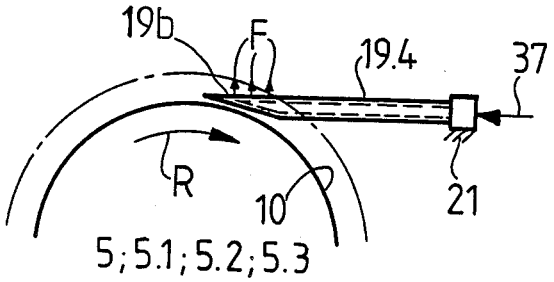
FIG. 18 equally illustrates in fragmentary view a still further modification of the texturing or crimping apparatus of the present development, again with respect to the taking-off or lifting means for the removal of the treated filament bundle from the texturing wheel.

FIG. 18 shows as the fiber or filament bundle-lifting or taking-off means, a lifting nozzle 19.4 which can eject compressed air in the conveying direction F in order to lift away from the stuffing chamber walls or wall members 7 and 8, the crimped filament bundle 2.1 disposed above the lifting nozzle and to supply such crimped filament bundle 2.1 to the next conveyor or outfeed structure or the like.

This lifting air nozzle 19.4 is rigidly connected to the machine part 21 and has a compressed air connection 37 for compressed air, generally indicated by the arrow.

The air ejected in the conveying direction F issues from appropriate apertures or openings, generally indicated by reference character 19*b* which are either disposed in an appropriate end zone or terminal region of the lifting nozzle 19.4 or are embodied by forming the lifting air nozzle 19.4 of a very porous material.

Figure 22:
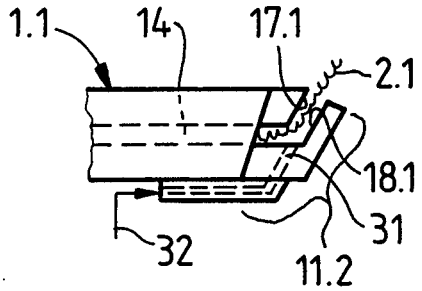
FIG. 22 illustrates on an enlarged scale and in fragmentary view a modified construction of the jet nozzle.

At this juncture is it remarked that FIG. 22 shows another construction of the outlet part or portion 11 and 11.1 previously considered. Here the outlet part or portion 11.2 is additionally formed with, for instance, an air exit or outflow opening or passage 31 connected to a compressed air connection 32 so that compressed air can enter the outlet part or portion 11.2 in the direction of the filament bundle 2.1 issuing from the outlet part 11.2. This compressed air can be used to control the aforedescribed bouncing or deflection of the filament bundle 2.1 at the bent wall 18.1. The fluid medium entering through an exit or outflow opening 31 can be the same or different than the heated medium flowing through the passage or channel 14.

Figure 23:
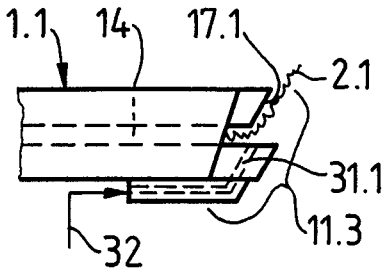
FIG. 23 illustrates on an enlarged scale and in fragmentary view, a further modified construction of the jet nozzle.

FIG. 23 shows a construction similar to FIG. 22. However, here there is no bent or deflecting wall 18.1 but there is an air exit aperture or opening or passage 31.1 which, like the air exit opening or passage 31, blows or issues towards the filament bundle 2.1 conveyed by the filament-guiding passage or duct 14 in order to deflect the filament bundle 2.1 without any bouncing at the bent wall 18.1.

Figure 24:
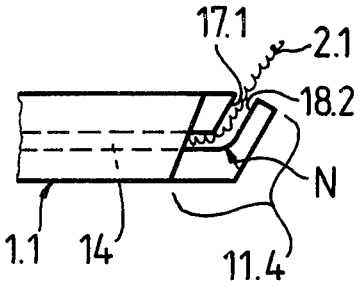
FIG. 24 illustrates on an enlarged scale and in fragmentary view, a still further modified construction of the jet nozzle.

FIG. 24 shows the jet nozzle 1.1 with an outlet part 11.3 differing from the outlet part or portion 11.1 of the arrangement of FIG. 21 by here having a radius N in the wall 18.2 to define a rounded portion or transition region. This radius provides an alternative form from the air stream of FIG. 22 for controlling the bouncing effect of the bent wall 18.2.

Figure 25:
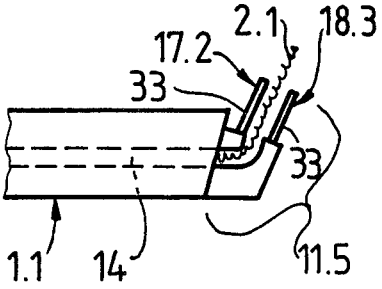
FIG. 25 illustrates on an enlarged scale and in fragmentary view, yet a further modified construction of the jet nozzle.

FIG. 25 shows a further variation of the outlet part or portion 11.1 of FIG. 21 in that here the outlet part or portion 11.4 of FIG. 25 has needle walls 17.2 and 18.2 instead of the respective walls 17.1 and 18.1 of FIG. 21. The needle walls 17.2 and 18.2 of FIG. 25 are embodied by adjacently arranged needles or pins 33 with a small space or gap disposed between the individual needles 33 so that the air conveyed by the filament-guiding or conveying passage or duct 14 can escape near the spaced needles 33 in order to produce further pre-crimping of the filament bundle 2.1 near these needles 33. As in the variants shown in FIGS. 21 to 24, the first pre-crimping is produced in that passage part of the outlet part or portion which forms a continuation of the filament-guiding passage or duct 14.

The outlet parts or portions 11.1, 11.2, 11.3, 11.4 and 11.5 of FIGS. 21 through 25 are formed with not particularly referenced recesses or openings corresponding to the aforediscussed recesses 15 and 16 in order to free or expose the filament-guiding or conveying passages 14 having the width d as shown in the drawings.

The invention can be used, for example, for the texturing or crimping of polyamide 6 and 66 and for polypropylene. It has been found by experience that for a filament bundle of 500 to 3,000 d tex there can be employed a distance D (FIG. 20) of 3 to 4.5 mm and a cross-section of the filament-guiding or conveying passage or duct 14 of from 10 to 20 $mm^2$, respectively.

While there are shown and described present preferred embodiments of the invention, it is to be distinctly understood that the invention is not limited thereto, but may be otherwise variously embodied and practiced within the scope of the following claims.

Accordingly, what I claim is:

1. A method of continuously crimping thermoplastic filaments of a filament bundle, comprising the steps of:

applying a jet of a heated medium to a filament bundle;

introducing the filament bundle by means of the jet of the heated medium through a jet nozzle into a stuffing chamber of elongate curvature moving with a predetermined circumferential velocity, the filament bundle being introduced into the stuffing chamber substantially tangentially with respect to said elongate curvature of said stuffing chamber and at a velocity which is greater than the predetermined circumferential velocity of the stuffing chamber; and positively retaining the filament bundle in elevated position within the stuffing chamber such that the heated medium can escape from all sides of the filament bundle located in the stuffing chamber.

2. The method as defined in claim 1, further including the steps of:

deflecting said heated medium together with the filament bundle at a predetermined angle at a deflecting plate prior to tangentially introducing the filament bundle into the stuffing chamber; and imparting to the filaments of the filament bundle by virtue of said deflection at the deflecting plate a pre-stuffing of the filaments.

3. The method as defined in claim 1, further including the steps of:

deflecting said heated medium together with said filament bundle, prior to tangentially introducing the filament bundle into the stuffing chamber, at a predetermined angle by a second jet of a medium which augments stuffing of said filament bundle within said stuffing chamber.

4. The method as defined in claim 3, further including the step of:

using as the second jet a medium which is different from the heated medium.

5. The method as defined in claim 3, further including the step of:

using as the second jet a medium which is the same as the heated medium.

6. The method as defined in claim 1, further including the steps of:

deflecting said heated medium together with said filament bundle prior to tangentially introducing said filament bundle into said stuffing chamber at a predetermined angle both by means of a deflecting plate and by means of a second jet of a medium;

pre-stuffing the filaments of the filament bundle due to the deflection of the filament bundle at the deflecting plate; and said second jet conveying the pre-stuffed filaments of the filament bundle into said stuffing chamber.

7. The method as defined in claim 1, further including the steps of:

retarding said heated medium together with said filament bundle in a retarding passage before tangentially introducing the filament bundle into the stuffing chamber; and pre-stuffing the filaments of the filament bundle in the retarding passage.

8. The method as defined in claim 7, further including the steps of:

deflecting said heated medium together with said filament bundle at a predetermined angle into a predetermined direction of movement of the filament bundle prior to said retarding of the heated medium together with said filament bundle; and feeding the filament bundle into said stuffing chamber while moving in said predetermined direction of movement.

9. A method of continuously texturing filaments of a filament bundle, comprising the steps of:

applying a medium jet to a filament bundle;

introducing the filament bundle by means of the medium jet into an elongated stuffing chamber moving with a predetermined circumferential velocity, the filament bundle being substantially tangentially introduced into said stuffing chamber at a velocity which is greater than the predetermined circumferential velocity of the stuffing chamber and in a direction such that the introduced filament bundle fails to contact the base of the stuffing chamber; and positively retaining the filament bundle in the stuffing chamber away from the base of the stuffing chamber such that the medium can escape from all sides out of the filament bundle located in the stuffing chamber.

* * * * *

UNITED STATES PATENT AND TRADEMARK OFFICE

CERTIFICATE OF CORRECTION

PATENT NO. : 4,877,570

DATED : October 31, 1989

INVENTOR(S) : WERNER NABULON

It is certified that error appears in the above-identified patent and that said Letters Patent is hereby corrected as shown below:

Title page, item 75, please amend address to read --Rüdlinge --

Column 2, line 59, after "using" please delete "a"

Column 3, line 4, after "threads" please delete "is" and insert --in--

Column 5, line 45, after "an" please delete "annual" and insert --annular--

Column 8, line 4, after "4b," please delete "having" and insert --have--

Column 8, line 11, after "to" please delete "constituted" and insert --constitute--

Column 9, line 22, after "perforated" please delete "annual" and insert --annular--

UNITED STATES PATENT AND TRADEMARK OFFICE
CERTIFICATE OF CORRECTION

PATENT NO. : 4,877,570

DATED : October 31, 1989

INVENTOR(S) : WERNER NABULON

It is certified that error appears in the above-identified patent and that said Letters Patent is hereby corrected as shown below:

Column 10, line 14, after "juncture" please delete "is it" and insert --it is--

Signed and Sealed this

Fifth Day of February, 1991

*Attest:*

HARRY F. MANBECK, JR.

*Attesting Officer*

*Commissioner of Patents and Trademarks*